US007204190B2

(12) United States Patent
Englund

(10) Patent No.: US 7,204,190 B2
(45) Date of Patent: Apr. 17, 2007

(54) METHOD AND DEVICE FOR INITIATION AND IGNITION OF EXPLOSIVE CHARGES THROUGH SELF-DESTRUCTION OF A LASER SOURCE

(75) Inventor: Owe Englund, Karlskoga (SE)

(73) Assignee: Bofors Bepad AB (SE)

( * ) Notice: Subject to any disclaimer, the term of this patent is extended or adjusted under 35 U.S.C. 154(b) by 270 days.

(21) Appl. No.: 10/471,459

(22) PCT Filed: Feb. 25, 2002

(86) PCT No.: PCT/SE02/00319

§ 371 (c)(1),
(2), (4) Date: Feb. 4, 2004

(87) PCT Pub. No.: WO02/073116

PCT Pub. Date: Sep. 19, 2002

(65) Prior Publication Data

US 2004/0123763 A1 Jul. 1, 2004

(51) Int. Cl.
*F42B 3/113* (2006.01)

(52) U.S. Cl. ..... 102/201; 372/70

(58) Field of Classification Search ..... 102/201; 372/70, 71

See application file for complete search history.

(56) References Cited

U.S. PATENT DOCUMENTS 3,408,937 A * 11/1968 Lewis et al. ..... 102/201
3,618,526 A * 11/1971 Baker ..... 102/201
4,391,195 A * 7/1983 Shann ..... 102/201
4,870,903 A * 10/1989 Carel et al. ..... 102/201
4,892,037 A 1/1990 Betts
4,898,095 A 2/1990 Tasaki et al.
5,022,324 A * 6/1991 Rice, Jr. ..... 102/201
5,206,455 A * 4/1993 Williams et al. ..... 102/201
6,081,369 A * 6/2000 Waarts et al. ..... 359/341.33
6,199,483 B1 * 3/2001 Barbiche ..... 102/201
6,460,460 B1 * 10/2002 Jasper et al. ..... 102/201
6,499,404 B1 * 12/2002 Kern et al. ..... 102/201

FOREIGN PATENT DOCUMENTS

DE 2712168 9/1977
FR 2760266 A1 * 9/1998

* cited by examiner

*Primary Examiner*—James S. Bergin
(74) *Attorney, Agent, or Firm*—Connolly Bove Lodge & Hutz, LLP; Larry J. Hume

(57) ABSTRACT

The present invention relates to a new method, based on laser technology, of initiating explosive charges (6, 10, 17, 30), and a device which is intended for initiating explosives and in accordance with said method functions according to entirely new principles. The basic idea underlying the invention is to ignite the explosive charge concerned not as previously proposed by means of the radiation emitted from a laser but by way of self-destruction or overheating of a laser source (2, 11, 18, 25, 33) assembled together with the explosive charge (6, 10, 17, 30). In this regard, the aim is to cause the laser source to melt down or explode and, in connection with this, to initiate the explosive. With the present invention, it has suddenly become possible to use even very small laser sources of the mini or micro type for triggering explosive charges where it was previously necessary to use very powerful laser sources for the same purpose.

13 Claims, 3 Drawing Sheets

METHOD AND DEVICE FOR INITIATION AND IGNITION OF EXPLOSIVE CHARGES THROUGH SELF-DESTRUCTION OF A LASER SOURCE

CROSS-REFERENCE TO RELATED APPLICATIONS

This application is a National Stage Entry of PCT/SE02/00319 filed on Feb. 25, 2002, which claims priority under 35 U.S.C. §119 to Swedish Application 0100864-8, filed on Mar. 14, 2001.

BACKGROUND OF THE INVENTION

The present invention relates to a new method, based on laser technology, of initiating explosive charges, and a device which is intended for initiating explosives and in accordance with said method functions according to entirely new principles. The basic idea underlying the invention is to ignite the explosive charge concerned not as previously proposed by means of the radiation emitted from a laser but by way of self-destruction or overheating of a laser source assembled together with the explosive charge. In this regard, the aim is to cause the laser source to melt down or explode and, in connection with this, to initiate the explosive. With the present invention, it has suddenly become possible to use even very small laser sources of the mini or micro type for triggering explosive charges where it was previously necessary to use very powerful laser sources for the same purpose.

Although there are a number of different ignition systems based on pyrotechnics for explosive charges, most conventional ignition systems intended for this purpose are based on electric ignition. This is true of both civil and military applications. The common disadvantage of all electric ignition systems is their great sensitivity to external influences, which makes them difficult to handle in a completely safe manner because this sensitivity is difficult to design out. The problem is accentuated on account of the fact that in modern society we are surrounded by more and more radiofrequency radiation, at the same time as the electric conductors which are unavoidable in electric igniters can always function as antennas, which can give rise to accidental triggering.

The optical maser or laser (Light Amplification by Stimulated Emission of Radiation) exists in a countless number of forms depending mainly on the laser material used. However, the basic principle of all laser types is that amplification of light is brought about by stimulated emission. For this purpose, in the first place a suitable laser material is required, in which the relevant components may be atoms, molecules or electrons, with at least two well-defined energy states. If gas lasers are disregarded, the laser material normally consists of a preferably rod-shaped crystal material, for which reason reference is often made to laser crystals or laser rods. Also required for the functioning of the laser is an energy source which supplies energy to the laser material in a quantity and form which can excite the active components in the laser material to a higher energy state, which means that the material begins to lase, that is to say to transmit a laser beam. Supplying energy to a laser is usually referred to as pumping the laser, and this can be effected in many laser materials by supplying light, which is also preferable in connection with the present invention. The third essential component of the laser is an optical resonator in the form of at least two mirrors arranged at the ends of the laser crystal and oriented in such a manner that the radiation inside the crystal is reflected between the mirrors. When the aim is to take a laser beam out of the laser source, one of the mirrors must be semi-transparent so that part of the radiation which bounces between the two mirrors of the resonator can come out. The generation of the laser beam itself begins with photons spontaneously emitted in all directions from the pumped laser material, and the photons which are reflected on the resonator mirrors are returned into the laser material and there cause stimulated emission of photons with the same wavelength, direction and phase. It is these properties which give the laser beam its coherent properties. In a conventional laser, part of the radiation is then taken out via the semi-transparent mirror. As long as the laser is pumped with energy, the laser beam will continue to be emitted.

In addition to the lasers which use solid and then preferably crystalline laser material, there are also, as already indicated, gas lasers, and amongst these there are also lasers consisting of specific gas mixtures which can be pumped with light and therefore could be of interest in connection with the present invention. However, those lasers which have to be pumped with electrical energy are of less interest in this context because these, owing to the fact that they require electric conductors for supplying the pumping energy, in principle have the same weaknesses in terms of safety as conventional electric igniters.

Over a number of years, the space and military industry has developed and made use of laser-based ignition systems. In such laser-based ignition systems, the laser is utilized in order to generate a heat pulse which is supplied to the ignition unit via a fibre optic light conductor or cable. These laser igniters have nevertheless proved very expensive because they require very powerful and thus expensive laser sources even when special amplification elements, for example lenses or convex mirrors, are used between the laser source and the initiation location. Laser-based explosive igniters have therefore hitherto been used principally in more exclusive technical areas where the price has not been too crucial a factor.

The advantages of a laser-based ignition system are primarily associated with its great safety in that it can be shielded from every form of external influence.

The theoretically simplest laser igniter for an explosive charge is that which quite simply consists of a fibre optic light conductor of which the outer end is coated with a conventional pyrotechnic composition which will therefore be ignited by the heat generated by a laser beam sent through the optical cable. This variant is simple and reliable but requires a very powerful laser source at the other end of the optical cable.

A slightly weaker laser source can be used if the laser beam is amplified directly before the pyrotechnic composition, and this can be effected by, for example, an optical lens, optical mirrors or a fibre optic light amplifier. All these previously proposed solutions are practicable, but the necessary laser source is of not inconsiderable strength in these variants as well and thus still relatively expensive.

In a further variant which manages with a somewhat weaker laser source, an IR-absorbing material is arranged between the outer end of the optical cable and the pyrotechnic composition at the same time as the heat absorption capacity of the latter is augmented by, for example, adding carbon powder. The laser intended for igniting a pyrotechnic composition can also, by way of the selection of laser-emitting material, be tailored to the optimum absorption wavelength of the pyrotechnic composition used. Even if this is done, relatively strong lasers are nevertheless still required in order to ignite a pyrotechnic composition by laser in accordance with the previously known art described very briefly above.

A further variant which has the special effect that it provides exploding ignition but which requires a very powerful laser source is the laser igniter which starts by gasifying a suitable medium, for example a plastic film, and accelerating this medium through a tube towards the explosive to be initiated.

Another known basic principle for laser igniters for explosives is characterized in that a laser diode is arranged in direct proximity to or inside the explosive and in that this laser diode is supplied with electric voltage when the explosive is to be initiated. In precisely the same way as a conventional electric igniter, however, this igniter is dependent on an ignition current which is supplied via ordinary electric conductors and it is therefore affected just as easily by electromagnetic pulses from other electrical equipment as the conventional electric igniters and can therefore be used to the same limited extent as these, without extra safety arrangements, in situations where other electrical equipment may be used in the immediate surroundings.

SUMMARY OF THE INVENTION

As already indicated in the introduction, the present invention relates to a method and a device for initiating explosive charges by means of a laser but, unlike laser ignition systems discussed above, makes do with a low-energy laser in order to implement the invention.

This is because the basic idea underlying the invention is that the explosive charge is initiated by self-destruction of a laser source or laser crystal of the mini or micro type assembled together with the explosive charge concerned, and to this end a low-energy laser pumped with light energy from a light source which is very limited at least in terms of time suffices. In this context, the term "to overload" means that the threshold value for self-destruction, which is generally referred to as the "damage threshold level" in laser literature and which it is not unusual occasionally to exceed by mistake, is exceeded. Depending on laser type, the laser will then exceed this value for self-destruction to explode or melt down, both of these being states which can be used for initiating an explosive.

As the aim of the invention is to bring about the desired initiation of the explosive charge so rapidly that it is perceived as instantaneous, there is no need either for a sustained energy supply to the laser source. According to a development variant of the invention, the laser eruption generated by an ordinary photo flash is therefore entirely adequate in order, via a fibre optic light conductor, to pump the necessary energy to the laser source which will in turn, by its own self-destruction, give rise to the desired detonation. The invention of course includes the laser source used, with the utilization of all known laser technology, being tailored for the very special purpose it now has, namely exceeding the threshold value for self-destruction as rapidly as possible after pumping.

The light source which will be required for pumping the laser concerned in connection with the present invention must nevertheless differ sufficiently from daylight so as not to involve any safety risks. A particularly preferred variant of the invention proposes that a conventional photo flash, a great many different types and light strengths of which are available on the market, is used as the light source for starting up the laser source.

As far as the need for inexpensive small laser sources which could meet the requirements in accordance with the present invention is concerned, development in this direction has taken such great steps forward that it is only a matter of time until such laser sources are available on the open market at very favourable prices. Work which points in this direction is described in on the one hand an article in APPLIED OPTICS/Vol. 39, No. 15/20, May 2000 entitled "Monobloc laser for low-cost, eyesafe, microlaser rangefinder" by J. E. Nettelton et al and on the other hand in a newsletter from KTH in Stockholm entitled "Eye-safe Microchip Lasers" by S. Kelly and F. Laurell. With the technology described in these two references, it will clearly be possible to produce the type of low-energy monolithic laser required for implementing the present invention on a larger scale.

The simplest way of producing the laser-emitting material for the microchip laser type required for implementing the present invention will be in large sheets which are divided into smaller pieces and ground. This circumstance led to the idea of a development of the laser source, namely that it should be facet-ground for the maximum possible internal reflections. This is in order to achieve the desired self-destruction and thus initiation of the explosive concerned as rapidly as possible.

The rapid advance of the telecommunications industry and consumer electronics has also resulted in the possibility of mass-producing semiconductor-based laser diodes today at reasonable prices at the same time as the widespread use of optical fibre cables has brought the price per metre of these down below the price of ordinary copper conductors. These laser diodes, which are readily available and inexpensive today and will be even more so tomorrow, have only one disadvantage as far as igniting explosive charges in accordance with any of the previously proposed methods is concerned. The laser beam which they emit is too weak to be capable of igniting an explosive charge, a problem which, however, the present invention circumvents by, instead of using the laser beam from the diode for igniting the explosive charge, designing the laser in such a manner that it exceeds its threshold value for self-destruction as rapidly as possible and in doing so melts down or explodes and in this connection initiates the explosive charge.

Low-energy lasers can even be used in order to initiate explosive charges in connection with the theoretically most simple variant of the invention by virtue of the fact that these lasers generate so much heat energy that they can rapidly be overheated and then initiate an explosive charge together with which they are to be assembled according to the invention. Such overheating of the laser source can be achieved rapidly if, for example, a sufficiently large part of the electromagnetic radiation emitted within the laser source is prevented from leaving the laser source, instead being amplified on each reflection within the laser source until overheating is achieved.

The self-destruction or overheating of the laser source is therefore achieved according to the invention by way of a sufficient quantity of or all the radiation energy gradually built up in the laser source being prevented from leaving the laser source in the form of free radiation, instead being successively reflected within the laser source and in this connection building up an increasingly great energy content and simultaneously heating the source to its melting point. The problem of cooling which is otherwise relevant in the laser context is therefore disregarded completely in this case at the same time as the most rapid radiation build-up possible is sought. This effect can be achieved by, for example, all the mirrors in the optical resonator of the laser being made opaque at the same time as the laser is pumped from the side, that is to say between the mirrors. This is because all the radiation build-up reflected between the mirrors will then be retained in the laser material and there give rise to a great surplus heat. The end mirroring found in the laser source as a constant feature can also be made from an easily gasified metal or metal alloy in order to accelerate the initiation of the explosive charge.

In another special embodiment of the device according to the invention, the ignition power of the overloaded laser source is augmented by at least that side of the laser-beam-forming crystal facing the initiating light flux being mirrored with an exothermic alloy.

Supplementing a conventional electric igniter with an exothermic alloy in order to increase its ignition power is previously known per se from an article entitled "The Reactive Bridge: A Novel Solid-State Low Energy Initiator" by T. A. Baginski. Suitable metals in such an exothermic alloy may be Al—Pd, Al—Pt, B—Ti and others. On the other hand, using the same idea in a laser igniter designed in the manner described here has to our knowledge not been proposed previously.

In a further variant of the invention, the self-destruction of the laser source is brought about by an explosion which tears the laser source apart and generates a pressure wave which initiates the explosive assembled together with the laser source. In this variant, the laser-active material or the crystal may, for example, have been produced under such conditions that their spatial structure contains enclosed air bubbles or other gas bubbles which, when the crystal is heated during laser-beam generation, lead to the laser source exploding as a result of the expansion of the gas enclosed therein.

To sum up, it can therefore be stated that the basic idea underlying the present invention is to construct a self-destructing laser which, instead of releasing the peak powers generated therein in the form of laser radiation, drives itself to self-destruction in order, when it melts down or explodes, to initiate an explosive together with which it is assembled to form a unit. For this basic idea to be commercially feasible, an inexpensive small laser source is required, which can be started up by a likewise inexpensive light source, and, as mentioned above, these components are already available on the market today and can be expected to become even less expensive in the future.

As mentioned above, an ordinary photo flash can therefore be sufficient in order to pump the low-energy laser initiator used in connection with the present invention, but other sufficiently bright light sources can also be used for this purpose. Other alternatives could be, for example, a pyrotechnic composition or a low-power laser diode or array of the same arranged so close to its own power source that it cannot be interfered with by, for example, electromagnetic pulses from other electrical equipment. A microchip laser can also be used for the same purpose.

As what is being sought in accordance with the present invention is a defined heat pulse of sufficient power, which drives the laser source to self-destruction as rapidly as possible, there is nothing to prevent the laser source or laser crystal selected for the purpose being doped with a number of laser-active materials. It is true that this would result in the laser radiation obtained losing its otherwise monochromatic properties, but it can increase its heat output, which is of greater interest in this case.

Other ways of increasing or accelerating the desired self-destruction could be suitable facet-grinding of the end surfaces of the laser-forming crystal, which, when the internal reflection takes place during energy build-up, gives rise to defined "hot spots" on the mirrored end surfaces of the laser rod. Another kindred idea would be to honeycomb-grind or facet-grind the end surfaces of the laser crystal in order thus to bring about acceleration of overheating in points and edges of the facet-grinding.

According to a further variant of the invention, the ignition function has been accelerated by the laser crystal or laser rod used in this connection having been provided with a boring in which a material melting at a low temperature or an explosive has been arranged. The time up to self-destruction of the laser crystal could also be reduced significantly if a stack of different switch crystals for different pulse transmission in time, what is known as a burst generator or a Q-switch, is arranged directly in front of the end mirroring, made from an exothermic alloy, of that end wall of the laser crystal facing the pumping direction.

The invention has been defined in the patent claims below and will now be described in slightly greater detail in connection with accompanying figures, which show diagrammatically three different ignition systems designed in accordance with the invention and each adapted to its explosive charge.

DETAILED DESCRIPTION OF THE INVENTION

Figure 1:
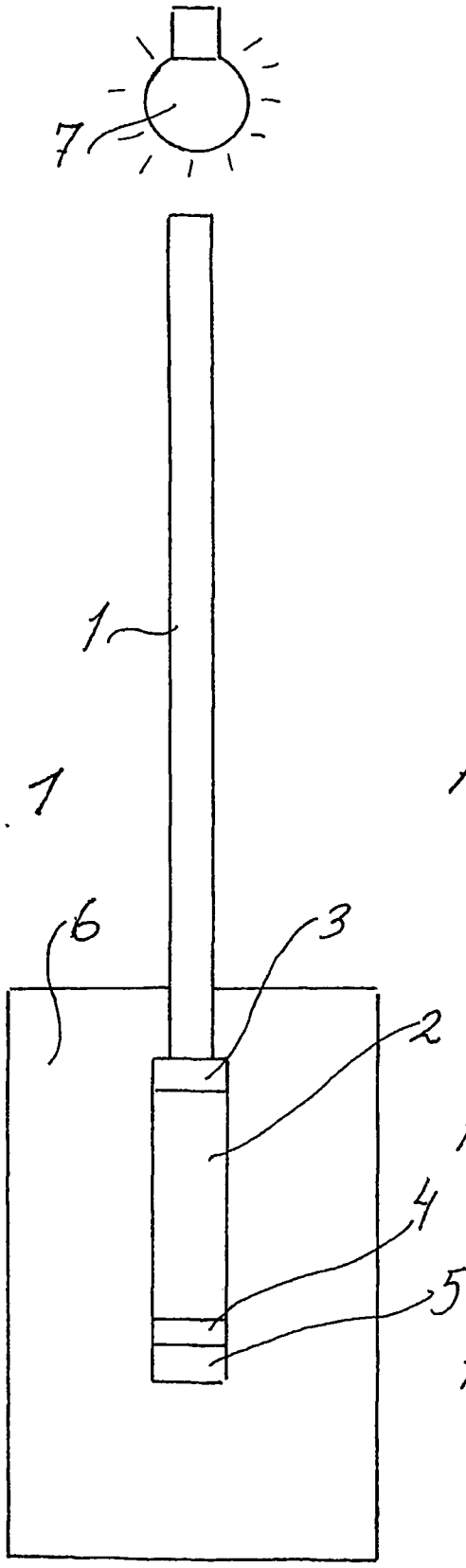
FIGS. 1–5 show diagrammatic longitudinal sections through different ignition systems according to the invention together with indications of the explosive charges they are intended to initiate.

FIG. 1 therefore shows an ignition system comprising a fibre optic light conductor 1, a laser crystal 2 provided with a dielectric end mirroring 3 which is light-permeable under certain conditions, what is known as a Q-switch 4 and a second end mirroring 5 made from a suitable exothermic alloy. The whole laser source or laser rod 2 is arranged inside an explosive charge 6. For pumping the laser and triggering the explosive charge 6, a conventional photo flash light 7 is arranged at the outer end of the optical cable 1. When the photo flash 7 is triggered, a light pulse is sent through the optical cable 1 to the laser 2 which, on account of its special properties designed in accordance with the invention, will within a very short space of time be overloaded and in this connection initiate the explosive charge 6 so that the latter is caused to explode.

Figure 2:
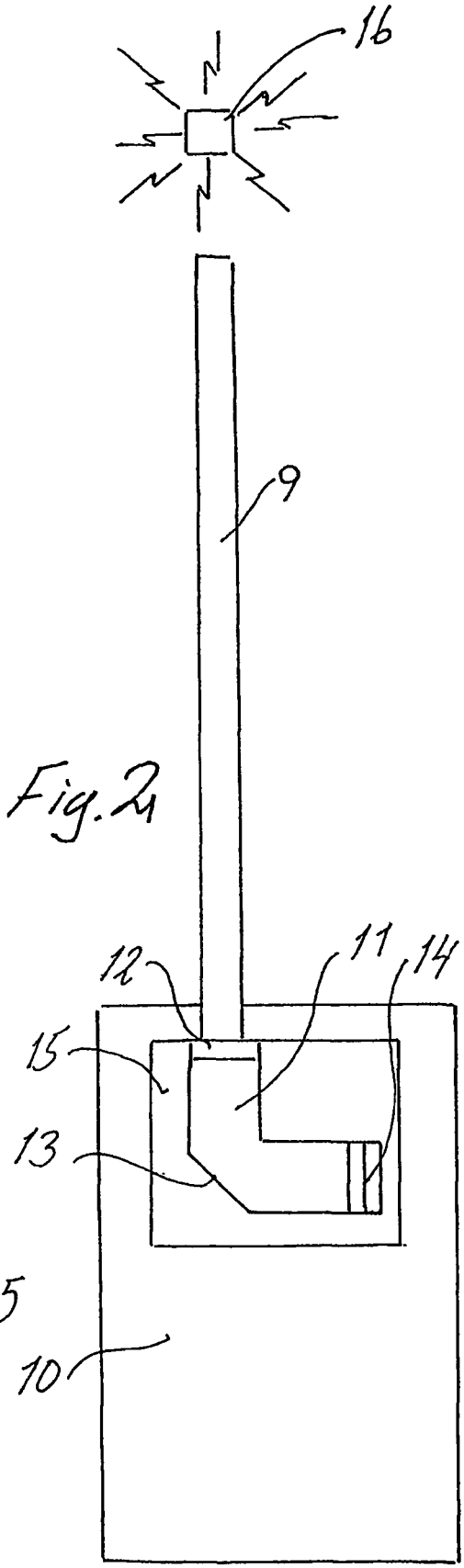

In the ignition system shown in FIG. 2, the construction is slightly different but in accordance with the same principles. Here too there is a fibre optic light conductor 9 for conducting the ignition pulse from the ignition location to the explosive charge designated by reference number 10 here. The laser source or laser rod 11 used is in this case angled and designed with a first dielectric inlet mirroring 12, a second angle mirroring 13 and a third exothermic end mirroring 14. The entire laser source 11 is also built into a booster charge 15, and, for initiating the explosive charge 10, a smaller pyrotechnic charge 16 is arranged outside the free outer end of the optical cable. If the pyrotechnic charge 16 is initiated, the laser source 11 will be pumped, and initiation of the charge 10 will be brought about, with the difference relative to FIG. 1 that the booster charge 15 functions as an intermediate stage.

Figure 3:
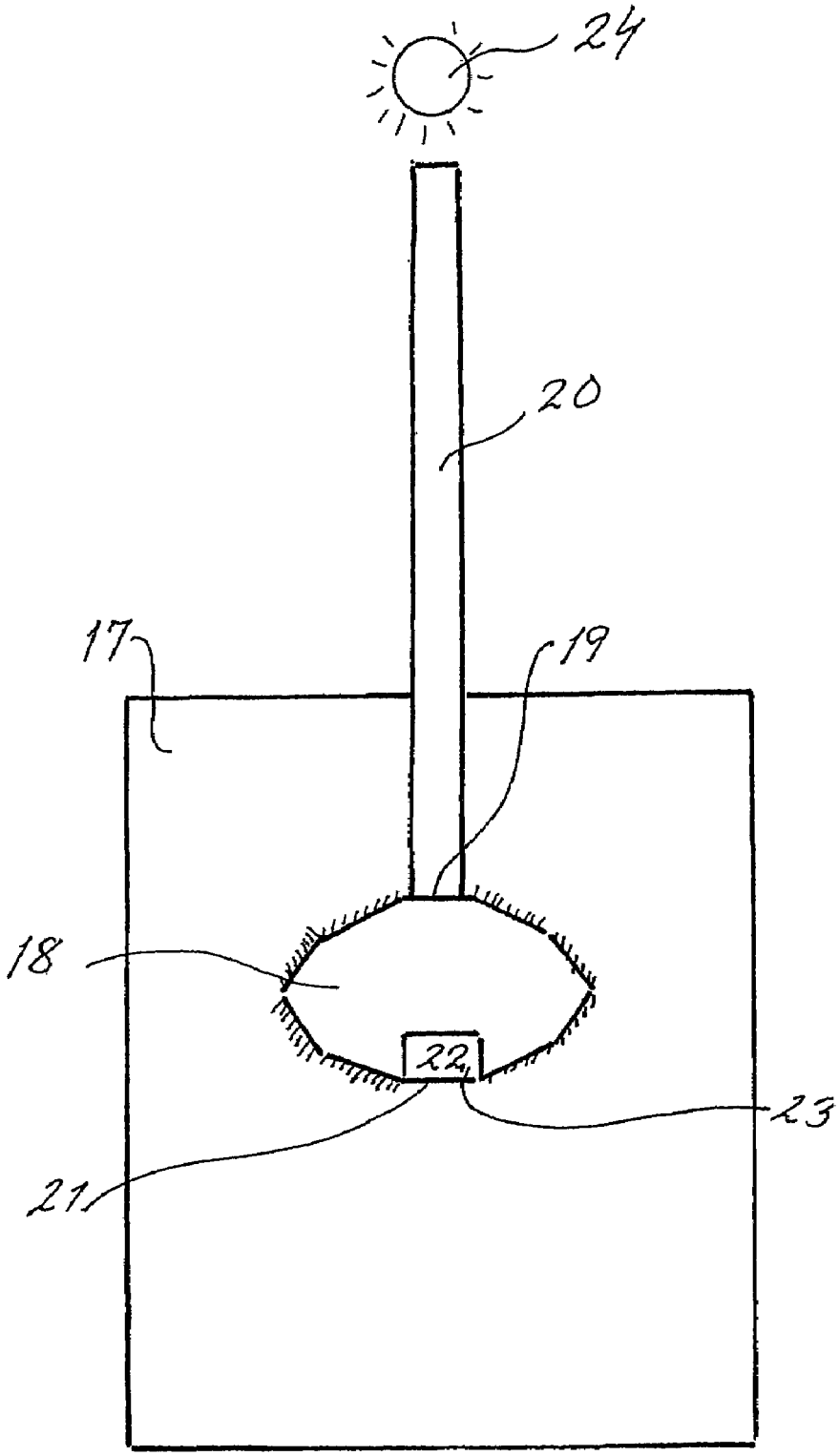

FIG. 3 shows a further variant of the device concerned, comprising an explosive charge 17 into which a facet-ground prismatic laser crystal 18 is built. All the facet surfaces of the laser crystal 18 are externally mirrored with the exception of a first facet surface 19 which is the entry surface for light-pumping the laser crystal and directly connected to a fibre optic light conductor 20, and a second facet surface 21 which adjoins a boring 23 filled with a primary explosive 22. The facet-grinding of the laser crystal 18 is designed so as to provide maximum internal reflection of the radiation emitted in the crystal when pumping takes place. This is in order to achieve self-destruction of the laser crystal as rapidly as possible. In order further to accelerate the sequence and increase the power thereof, the primary explosive 22 has also been encapsulated in the boring 23. For pumping the laser crystal 18 and initiation of the explosive charge 17, there is also a light source 24.

Figure 4:
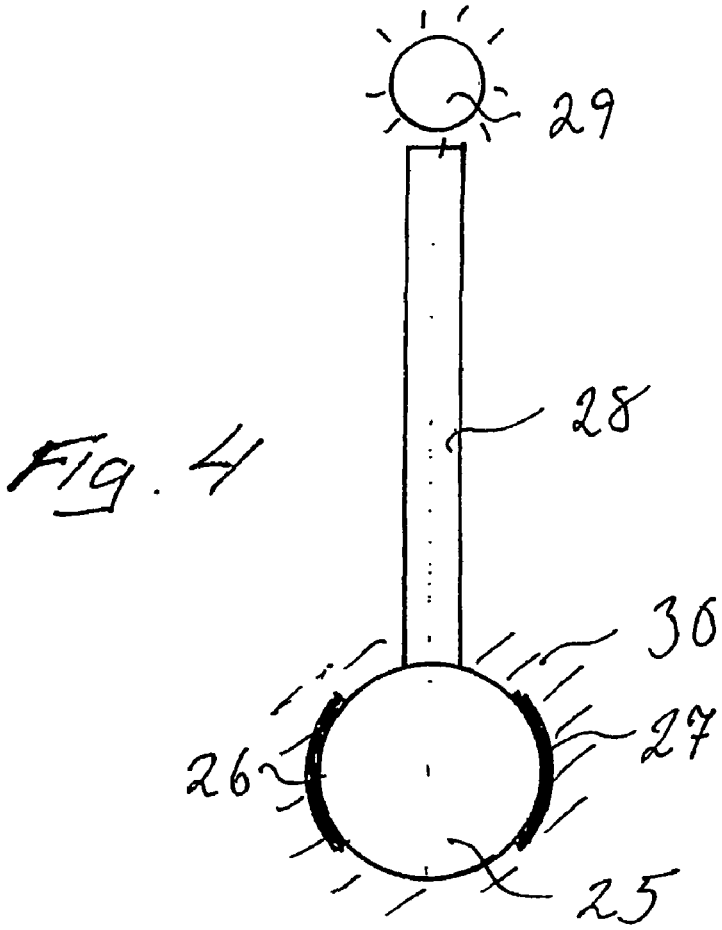

FIG. 4 shows another variant of the invention, comprising a ball-shaped laser crystal 25 provided with mirrorings 26, 27, and the pumping of the same is carried out by means of a fibre optic light conductor 28. There is furthermore a light source 29, and the laser crystal 25 is entirely embedded in the explosive 30.

Figure 5:
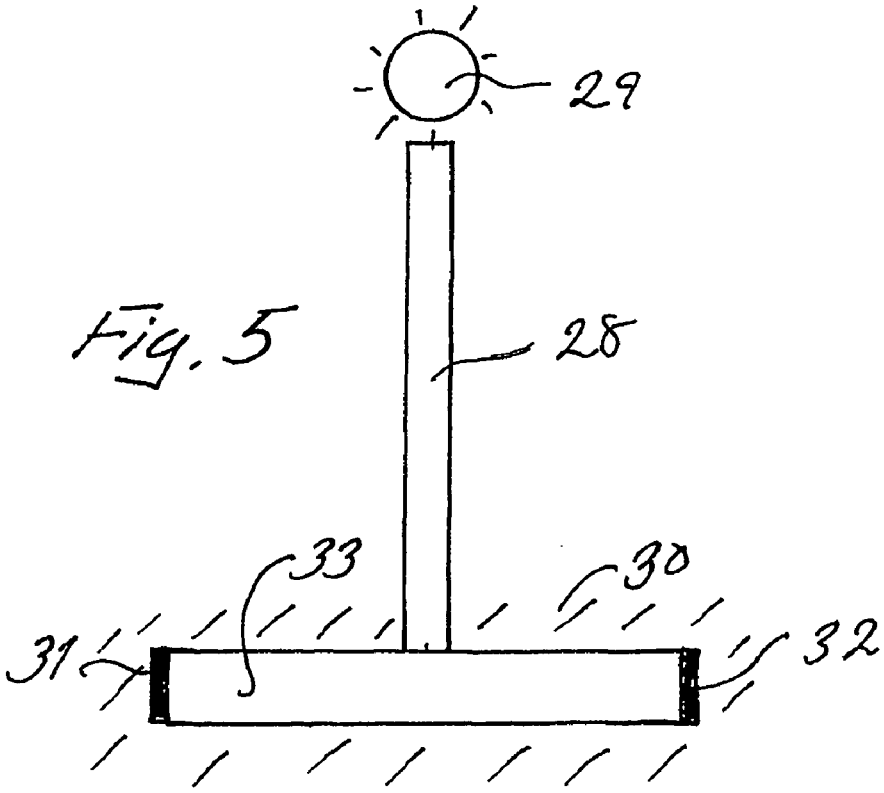

The device shown in FIG. 5 comprises the light source 29, the optical cable 28 and the explosive 30. However, the laser crystal has in this case been replaced by what is known as a side-pumped laser 33 with end mirrorings 31 and 32. These could therefore be made of an exothermic or easily gasified material.

The invention claimed is:

1. An apparatus for initiating an explosive charge, the apparatus comprising:

a laser source suitable for arrangement within the explosive charge;

an optical fiber operatively coupled to the laser source; and a light source coupled to the optical fiber, wherein the light source pumps the laser source, wherein the laser source is configured to either overheat or explode so as to initiate the explosive charge in response to being pumped by the light source.

2. The apparatus of claim 1, wherein the laser source comprises an optical resonator in the form of at least two end mirrors directed towards each another.

3. The apparatus of claim 1, wherein the laser source comprises a laser crystal.

4. The apparatus of claim 1, wherein the laser source comprises a doped crystal which enables emission of radiation having a plurality of different wavelengths.

5. The apparatus of claim 1, wherein the laser source comprises a facet-ground surface-mirrored crystal arranged so as to provide a maximum internal reflection of rays emitted in the crystal, said rays emitted in the crystal being prevented from leaving the crystal so as to rapidly increase a temperature of the crystal to a self-destruction temperature thereof.

6. The apparatus of claim 1, wherein the laser source comprises a crystal material having a boring into which a meltable material is inserted, said meltable material having a relatively lower melting point and being more inclined to explode when heated in comparison to the crystal material.

7. The apparatus of claim 1, wherein the laser source is a self-destructing laser.

8. The apparatus of claim 7, wherein the self-destructing laser is configured to either overheat or explode so as to initiate the explosive charge.

9. The apparatus of claim 1, wherein laser light produced by the laser source produces light that is insufficient to directly initiate the explosive charge.

10. An apparatus for initiating an explosive charge by a laser, the apparatus comprising:

a laser source arranged at an effective location within the explosive charge;

an optical fiber operatively coupled to the laser source; and a light source coupled to the optical fiber, wherein the light source pumps the laser source, wherein the laser source comprises an optical resonator in the form of at least two end mirrors directed towards each another, and wherein at least one of the at least two end mirrors comprises an exothermic alloy selected from the group consisting of Al—Pd, Al—Pt, and B—Ti, and wherein the laser source is configured to either overheat or explode so as to initiate the explosive charge in response to being pumped by the light source.

11. An apparatus for initiating an explosive charge by a laser, the apparatus comprising:

a laser source arranged at an effective location within the explosive charge;

an optical fiber operatively coupled to the laser source; and a light source coupled to the optical fiber, wherein the light source pumps the laser source, wherein the laser source comprises a crystal having an internal structure which includes gas-filled bubbles in a quantity sufficient to cause the crystal to explode when the gas in the bubbles is heated and expanded, wherein the laser source is configured to either overheat or explode so as to initiate the explosive charge in response to being pumped by the light source.

12. An apparatus for initiating an explosive charge by a laser, the apparatus comprising:

a laser source arranged at an effective location within the explosive charge;

an optical fiber operatively coupled to the laser device; and a light source coupled to the optical fiber, wherein the light source pumps the laser device, wherein the light source comprises a photo flash which, when triggered, delivers light to the laser device via the optical fiber so as to pump the laser source, and wherein the laser source is configured to either overheat or explode so as to initiate the explosive charge in response to being pumped by the light source.

13. An apparatus for initiating an explosive charge by a laser, the apparatus comprising:

a laser source arranged at an effective location within the explosive charge;

an optical fiber operatively coupled to the laser source; and a light source coupled to the optical fiber, wherein the light source pumps the laser source, wherein the laser source comprises an optical resonator in the form of at least two end mirrors directed towards each another, wherein the at least two end mirrors comprise at least one of an exothermic metal alloy, an easily gasified metal, and a metal alloy, wherein said at least two end mirrors prevent a laser beam generated by the laser device from leaving the laser device, and wherein the laser source is configured to either overheat or explode so as to initiate the explosive charge in response to being pumped by the light source.

* * * * *